US011585143B1

(12) United States Patent
Iriarte

(10) Patent No.: US 11,585,143 B1
(45) Date of Patent: Feb. 21, 2023

(54) AUTOMATIC DOOR OPENER SYSTEM

(71) Applicant: Gonzalo Fuentes Iriarte, Madrid (ES)

(72) Inventor: Gonzalo Fuentes Iriarte, Madrid (ES)

( * ) Notice: Subject to any disclaimer, the term of this patent is extended or adjusted under 35 U.S.C. 154(b) by 0 days.

(21) Appl. No.: 17/738,253

(22) Filed: May 6, 2022

Related U.S. Application Data

(63) Continuation-in-part of application No. 17/538,670, filed on Nov. 30, 2021, now abandoned.

(60) Provisional application No. 63/272,934, filed on Oct. 28, 2021.

(51) Int. Cl.
*E05F 15/60* (2015.01)
*E05F 15/611* (2015.01)
*E05B 47/00* (2006.01)

(52) U.S. Cl.
CPC ..... *E05F 15/60* (2015.01); *E05B 47/0001* (2013.01); *E05F 15/611* (2015.01); *E05Y 2900/132* (2013.01)

(58) Field of Classification Search
CPC ..... E05F 15/77; E05F 15/60; E05F 15/611; E05F 15/641; E05F 15/624; E05B 47/0001; E05Y 2900/132
See application file for complete search history.

(56) References Cited

U.S. PATENT DOCUMENTS 1,694,431 A * 12/1928 Russell ..... E05F 15/624 49/358
2,827,284 A * 3/1958 Bunzl ..... E05F 15/624 49/32
4,401,346 A * 8/1983 Jones ..... E05C 19/168 292/144
4,672,773 A * 6/1987 Bilt ..... E05F 15/635 49/358
5,353,029 A * 10/1994 Johnston ..... H01Q 17/00 342/4
6,338,536 B1 * 1/2002 Ueno ..... E05F 15/60 49/478.1

(Continued)

OTHER PUBLICATIONS

Automatic swing doors: Automatic swing door operator Manufactures. Caesardoor. Oct. 23, 2021. Available at: https://www.caesardoor.com/automatic-swing-door-opener.

(Continued)

*Primary Examiner* — Justin B Rephann
(74) *Attorney, Agent, or Firm* — Loeb & Loeb LLP

(57) ABSTRACT

An automatic door opening system including a door having a top portion, a bottom portion, a hinged portion, and an opening portion. The system includes an opener connected to the door adjacent the opening portion and configured to selectively receive electrical current. The system includes a magnet disposed on the opening portion of the door such that the magnet is adjacent the opener when the door is in the closed position. The system includes a microcontroller in electric communication with the electromagnet wherein a memory contains processor-executable instructions to receive a door activation input and, in response to receiving the door activation input, activate the electromagnet to apply a magnetic force against the magnet and push the door between the closed position and the open position. The system may also include a closer configured to selectively return the door to the closed position.

11 Claims, 4 Drawing Sheets

(56) References Cited

U.S. PATENT DOCUMENTS

| | | | | |
|---|---|---|---|---|
| 6,811,236 | B1 * | 11/2004 | Spong | F25D 23/028 49/276 |
| 7,021,005 | B1 * | 4/2006 | Curry | E05F 15/641 49/358 |
| 9,725,941 | B2 * | 8/2017 | Van Tassell, III | E05F 15/635 |
| 10,081,977 | B2 * | 9/2018 | Shelley | E05F 15/624 |
| 10,385,602 | B2 * | 8/2019 | Smith | E05D 5/0207 |
| 11,136,812 | B2 * | 10/2021 | Rabinowitz | E05F 15/624 |
| 11,174,664 | B2 * | 11/2021 | Sellinger | E05F 3/226 |
| 2004/0103584 | A1 * | 6/2004 | Freeman | E05F 15/624 704/E15.045 |
| 2006/0242908 | A1 * | 11/2006 | McKinney | E05F 15/73 49/280 |
| 2007/0186480 | A1 * | 8/2007 | Freeman | E05F 15/77 704/E15.045 |
| 2010/0115853 | A1 * | 5/2010 | Gebhart | H02P 6/28 49/506 |
| 2010/0242365 | A1 | 9/2010 | Langner et al. | |
| 2013/0318878 | A1 * | 12/2013 | Manseder | E05F 15/635 49/358 |
| 2013/0326960 | A1 * | 12/2013 | Manseder | E05F 15/624 49/358 |
| 2017/0306679 | A1 * | 10/2017 | Smith | E05D 5/0207 |
| 2018/0058130 | A1 * | 3/2018 | Shelley | E05F 15/611 |
| 2019/0292829 | A1 * | 9/2019 | Sellinger | E05F 15/77 |
| 2020/0102779 | A1 * | 4/2020 | Rabinowitz | E05F 15/624 |
| 2020/0386029 | A1 * | 12/2020 | Nash | E05F 15/624 |
| 2020/0406746 | A1 * | 12/2020 | Glickman | B60K 15/05 |
| 2021/0317697 | A1 * | 10/2021 | Tulsidas | E05F 15/60 |
| 2021/0355739 | A1 * | 11/2021 | Tulsidas | G06V 40/172 |

OTHER PUBLICATIONS

Office Action of Corresponding U.S. Appl. No. 17/538,670, dated Feb. 7, 2022, 22 pages.

* cited by examiner

AUTOMATIC DOOR OPENER SYSTEM

CROSS-REFERENCE TO RELATED APPLICATIONS

This application is a continuation-in-part application of U.S. patent application Ser. No. 17/538,670, filed Nov. 30, 2021, which claims priority to U.S. Provisional Application No. 63/272,934, filed Oct. 28, 2021, the disclosures of which are incorporated herein by reference in their entirety.

BACKGROUND

The background description provided herein is for the purpose of generally presenting the context of the disclosure. The work of the presently named inventors, to the extent it is described in this background section, as well as aspects of the description that may not otherwise qualify as prior art at the time of filing, are neither expressly nor impliedly admitted as prior art against the present disclosure.

Various circumstances may drive the need or desire for systems that allow people to open and/or close doors without touching a door handle. Because door handles are touched by many different people, they may be sources of virus transmission, such as COVID-19, influenza, etc., bacteria, or other undesirable substances, especially in high-traffic areas. Many swinging doors all over the world may benefit from being adapted for use without using the handle to open or close them. This may be particularly critical to areas such has hospitals, but also in other high traffic areas such as universities, offices, etc.

SUMMARY

The following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

In an embodiment, the disclosure describes an automatic door opening system. The system may include a door having a top portion, a bottom portion, a hinged portion, and an opening portion. The door may be configured to selectively rotate between a closed position and an open position about the hinged portion. The system may include an opener connected to the door substantially adjacent the opening portion. The opener may include a casing and an electromagnet housed within the casing and configured to selectively receive electrical current. The system may include a magnet disposed on the opening portion of the door such that the magnet is substantially adjacent the opener when the door is in the closed position. The system may include a microcontroller including a memory and one or more processors. The microcontroller may be in electric communication with the electromagnet and the memory may contain processor-executable instructions to receive a door activation input and, in response to receiving the door activation input, activate the electromagnet to apply a magnetic force against the magnet and push the door between the closed position and the open position.

In another embodiment, the disclosure describes an automatic door opener. The opener may include an electromagnet configured to be disposed on a door frame adjacent an opening portion of a door having a top portion, a bottom portion, a hinged portion, and the opening portion. The opener may include magnet disposed on the opening portion of the door such that the magnet is substantially adjacent the electromagnet when the door is in a closed position. The opener may include one or more processors in electronic communication with the electromagnet, and a memory containing processor executable instructions to receive a door activation input and, in response to receiving the door activation input, activate the electromagnet to apply a magnetic force against the magnet and push the door between the closed position and an open position.

In another embodiment, the disclosure describes an automatic door opening system. The system may include a door having a top portion, a bottom portion, a hinged portion, and an opening portion. The door may be configured to selectively rotate between a closed position and an open position about the hinged portion. The system may include an opener connected to the door substantially adjacent the opening portion. The opener may include a casing and an electromagnet housed within the casing and configured to selectively receive electrical current. The system may include a magnet disposed on the opening portion of the door such that the magnet may be substantially adjacent the opener when the door is in the closed position. The system may include a microcontroller including a memory and one or more processors, where the microcontroller may be in electric communication with the electromagnet. The system may include a sensor in electronic communication with the microcontroller. The sensor may be configured to receive an input signal for opening the door and communicate the input signal to the microcontroller. The system may include a locking mechanism disposed adjacent to the door and configured to selectively prevent the door from moving into the open position, where the locking mechanism may be in electronic communication with the microcontroller. The memory may contain processor-executable instructions to receive a door activation input and, in response to receiving the door activation input, activate the electromagnet to apply a magnetic force against the magnet and push the door between the closed position and the open position.

BRIEF DESCRIPTION OF THE DRAWINGS

The invention may be better understood by references to the detailed description when considered in connection with the accompanying drawings. The components in the figures are not necessarily to scale, emphasis instead being placed upon illustrating the principles of the invention. In the figures, like reference numerals designate corresponding parts throughout the different views.

Figure 1:
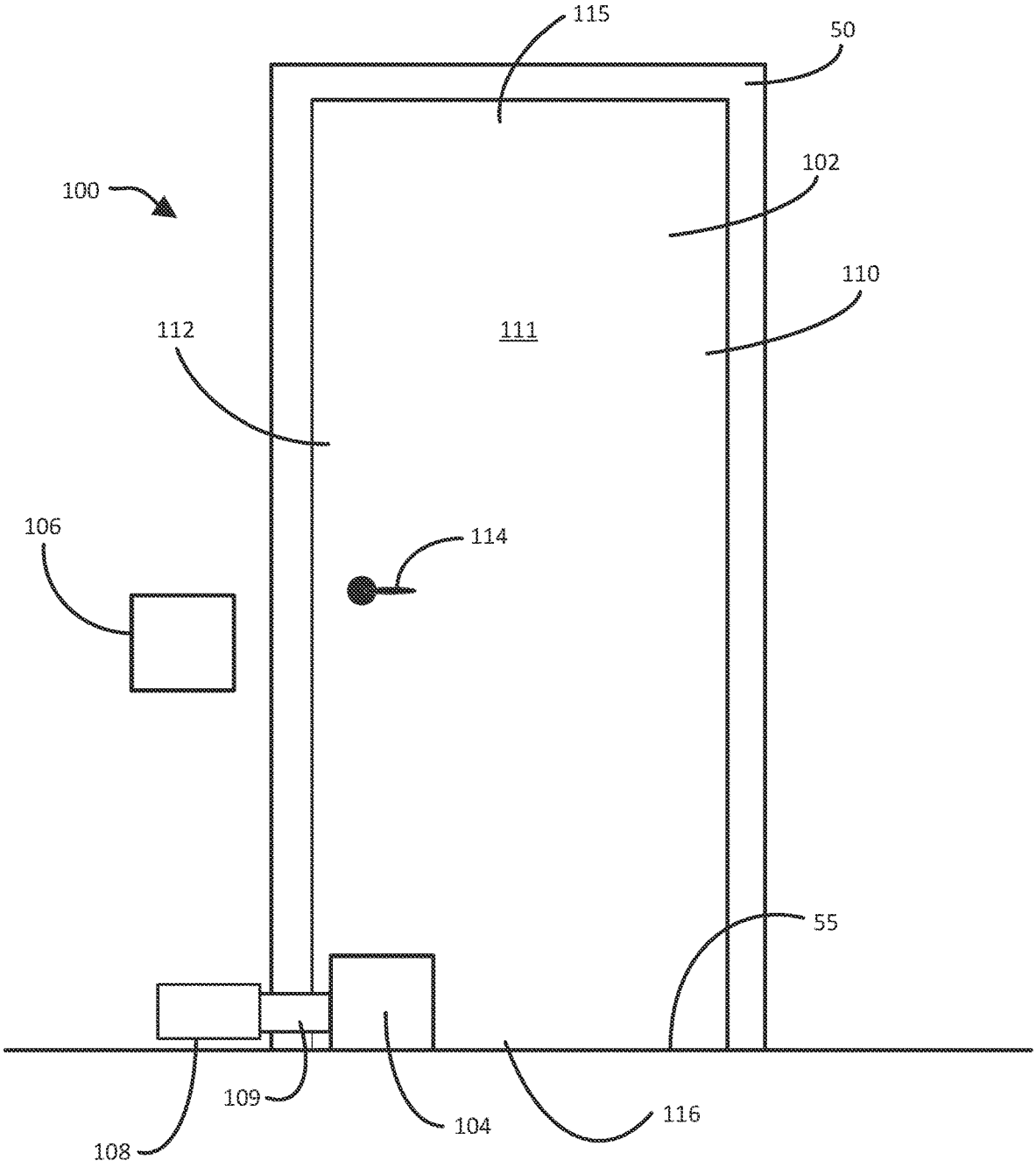
FIG. 1 is a front view of an embodiment of an automatic door opening system in accordance with the disclosure.

Persons of ordinary skill in the art will appreciate that elements in the figures are illustrated for simplicity and clarity so not all connections and options have been shown to avoid obscuring the inventive aspects. For example, common but well-understood elements that are useful or necessary in a commercially feasible embodiment are not often depicted in order to facilitate a less obstructed view of these various embodiments of the present disclosure. It will be further appreciated that certain actions and/or steps may be described or depicted in a particular order of occurrence while those skilled in the art will understand that such specificity with respect to sequence is not actually required. It will also be understood that the terms and expressions used herein are to be defined with respect to their corresponding respective areas of inquiry and study except where specific meaning have otherwise been set forth herein.

DETAILED DESCRIPTION

The present invention now will be described more fully hereinafter with reference to the accompanying drawings, which form a part hereof, and which show, by way of illustration, specific exemplary embodiments by which the invention may be practiced. These illustrations and exemplary embodiments are presented with the understanding that the present disclosure is an exemplification of the principles of one or more inventions and is not intended to limit any one of the inventions to the embodiments illustrated. The invention may be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Traditionally, automated systems for swinging doors may use motorized arms to open and close swing doors. In addition to being very expensive, these arms have the downside that they do not take advantage of the torque of force correctly, since they normally may not exert force at the end of the door where the door opens and closes but towards the door's middle. Such designs may include over engineering for the task to be solved—opening and closing a door—and using much more energy thus making the systems inefficient. In other words, some traditional automatic swinging door systems use an unnecessary amount of energy by not exerting a moment of force at the optimal point of the swing door. In turn, this may result in various problems, such as greater device fatigue and shorter usable life.

The disclosure describes, in some embodiments, an automatic door opening system that may apply the torque of force used to open or close the swing door in the part of the door where the torque of force is a substantially maximum or optimal. The system may, accordingly, allow for door opening and closing with lower or more optimized energy usage. Moreover, the system may be less expensive to manufacture or install when compared to traditional systems. In some embodiments, the automatic door opening system described herein may include a door opener positioned substantially on a distal end of a swinging door relative to a hinged end. Such positioning may provide for a greater moment arm as measured relative to the proximate, hinged end of the door, therefore requiring substantially less power to move the door between a closed and opened position, and vice versa.

Moreover, the system may be safer to use when compared to traditional systems. For example, some safety standards for swing doors may require using laser sensors, protection bands, or other protective measures at the hinged portion of the door. By using substantially less power to move the door between a closed and opened position, and vice versa, the automatic door opener may contribute to "relaxing" safety standards and providing a safer environment.

FIG. 1 shows an embodiment of the automatic door opening system 100. In some embodiments, the system 100 may include a swing-style door 102, an opener 104, a sensor 106, and a locking mechanism 108, such as a bolt. In some embodiments, the door 102 may include two opposing faces 111, a top portion 115, a bottom portion 116, a hinged portion 110, and an opening portion 112. In some embodiments, the door 102 may be disposed within a doorframe 50 such that a hinged portion 110 of the door 102 may be pivotally connected to the doorframe and allow the door to swing between an open position and a closed position about the hinged portion over a floor 55 or other surface. The door 102 may have a handle 114 that may be turned or otherwise activated to retract or extend a latch in order to open the door. In some embodiments, the door 102 may instead include a door knob or other mechanism with which to activate or deactivate a latch and/or unlocking the door or allowing for movement. In some embodiments, the latch may be disposed either in the opening portion 112 of the door 102 or in the door frame 50, and may be actuatable between a locked or unlocked position in order to secure the door in a closed position at least until the handle 114 or other actuating mechanism is activated to actuate the latch. In some embodiments, the door 102 may include no handle at all and the latch may only be controllable via electronic, magnetic, or other wired or remote systems. In some embodiments, the latch may be retracted electronically in response to an input, as described in greater detail below.

In some embodiments, the opener 104 may be disposed on the bottom portion 116 of the door 102 at or substantially near the opening portion 112. Locating the opener 104 near or at the opening portion 112 of the door 102 may provide for a more efficient application of torque to rotate the door into either an open or closed position with respect to the hinged portion 110 of the door. Specifically, the closer that the opener 104 may be to the opening portion 112 of the door 102, the longer the moment arm may be between the opener and the hinged portion 112 of the door. A longer moment arm may result in a lower force and, accordingly, a smaller and more energy-efficient motor may be used in the opener 104 to rotate the door about the hinged portion 112. As described in more detail below, when activated, the opener 104 may cause the door 102 to move from a closed position to an open position automatically without the need for a person to physically touch the door handle 114 or any other part of the door 102.

Figure 2:
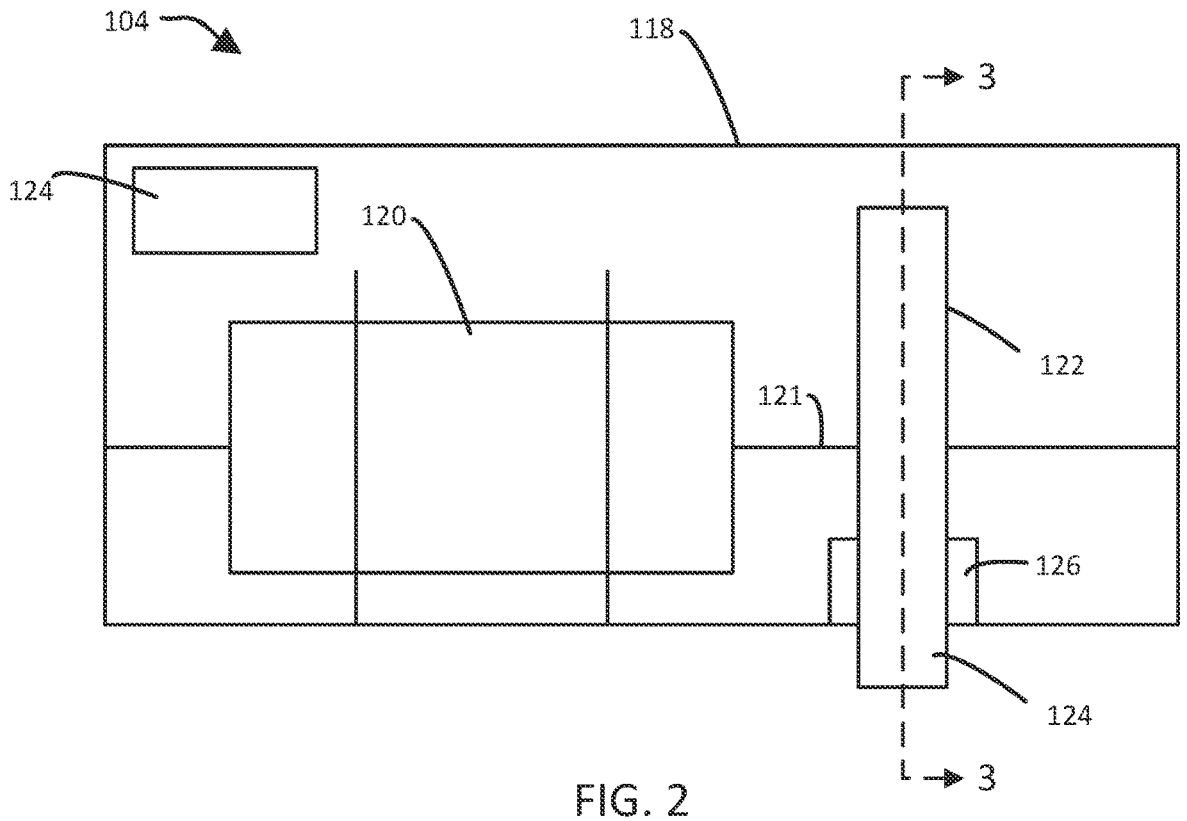
FIG. 2 is a schematic cross-sectional front view of an embodiment of an opener of the automatic door opening system of FIG. 1.

In some embodiments, such as illustrated in FIG. 2, the opener 104 may include a casing 118 that may house a motor 120 operably connected to a wheel 122, such as via an axle 121. In some embodiments, the opener 104 may be disposed at the bottom portion 116 of the door under the handle 114 so as to allow at least a portion of the wheel 122 to extend out from the bottom of the casing 118 and contact the floor 55. In some embodiments, the wheel 122 may be in contact with a spring (e.g., housed within the casing 118) that may facilitate the wheel's rotation, such as when encountering a small obstacle or a sloping surface adjacent the bottom portion of the door. In some embodiments, the motor 120 may be an electric motor that may be powered through a battery, wirelessly or through a hardwired electrical connection.

Figure 3:
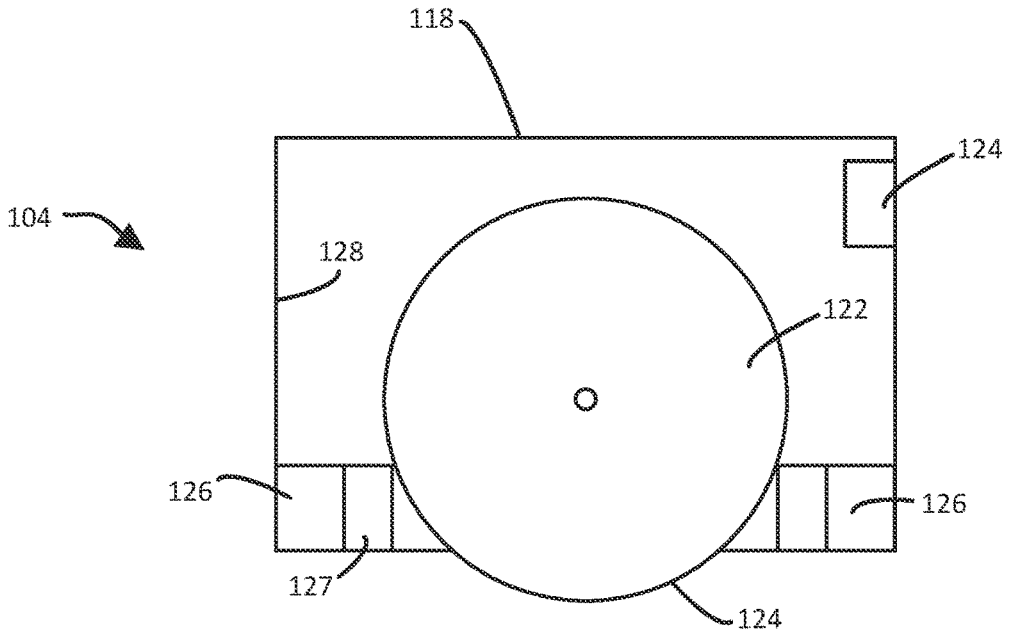
FIG. 3 is another schematic cross-sectional side view of the opener of FIG. 2.

As shown in FIG. 2 and FIG. 3, in some embodiments, the opener 104 may also include one or more brushes 126 that may be disposed within or on the casing so as to at least partially contact a rotating surface 124 of the wheel 122 and help limit or prevent build-up of dirt or other substances on the wheel surface. In some embodiments, the brushes 126 may be disposed on an inner portion 128 of the casing and disposed such that a bristle portion 127 of the brush may contact the wheel surface 124 with enough pressure to remove debris from the surface but while still allowing relatively easy rotation of the wheel 122. In some embodiments, the brushes 126 may be positioned on either side of the wheel 122 so that debris may be removed from the wheel surface 124 while it may be rotating in either direction (i.e., moving the door 102 into an open position or into a closed position). In some embodiments, the brushes 126 may help prevent build-up of debris that might otherwise interfere with the workings of the opener 104 such as by blocking wheel 122 rotation, jamming the motor, etc. In some embodiments, the wheel surface 124 may be made from or be coated in a rubber material or other high friction material that, while providing traction between the wheel 122 and the floor 55, may tend to collect debris that the brushes may help mitigate or prevent. In some embodiments, the brushes 126 may be replaced with or be supplemented by another type of debris removal system, such as compressed air jets that may blow debris off of the wheel surface 124. In some embodiments, the brushes 126 or other debris removal system may be positioned on either side of the wheel 122 adjacent the floor 55 so that debris may be removed from the floor surface 55 while the wheel may be rotating in either direction (i.e., moving the door 102 into an open position or into a closed position). In such embodiments, the amount of debris encountered by the wheel 122 may be reduced.

In some embodiments, the motor 120 and/or the wheel 122 may be connected to a microcontroller system 124 (such as an Arduino or other suitable system). In some embodiments, the microcontroller 124 may be included in the opener 104, such as by being housed within the casing 118. In some embodiments, the microcontroller 124 may be located elsewhere but in remote (wired or wireless) communication with the opener 104 and its components, such as in the sensor 106 or elsewhere. In some embodiments, the microcontroller 124 may be a single-board microcontroller and may use a variety of microprocessors and controllers. In some embodiments, the microcontroller 124 may include one or more processors and may include a memory that may contain processor-executable instructions that, when executed, may cause the opener to perform programmed actions. The microcontroller 124 may be equipped with sets of digital and analog input/output (I/O) pins that may be interfaced to various expansion boards or breadboards and other circuits. The microcontroller 124 may include serial communications interfaces, including universal serial bus (USB), which may be used for loading computer programmable instructions or other programming into the memory relating to the operation of the automatic door opener system 100. In some embodiments, the microcontroller 124 may be programmed using various programming languages such as C, C++, etc., and may also use application programming interfaces (APIs). In some embodiments, the microcontroller 124 may include use of compiler toolchains, and may provide an integrated development environment (IDE) and/or command line tools.

In some embodiments, the microcontroller system 124 may fulfill several tasks, such as controlling the number of turns of the wheel 122, controlling the wheel's angle of rotation, sensing whether the wheel has encountered any impediments, and/or sensing a position of the wheel and triggering a locking mechanism 108. In some embodiments, the microcontroller 124 may control the number of turns of the wheel 122 such that the angle of rotation of the door 102 may be programmed. In some embodiments, by sweeping a guide in contact with the wheel, the microcontroller system 124 may control the wheel's 122 angle of rotation in such a way that the wheel may follow the door 102 rotation path. In some embodiments, the microcontroller system 124 may sense if the motor 120 and/or wheel 122 has encountered an impediment that may prevent the wheel from continuing to turn. For example, the microcontroller 124 may sense that the motor 120 may be drawing additional or relatively high current in order to operate and interpret the current increase as the wheel/motor and/or the door 102 bumping against an impediment. In some embodiments, a threshold level of current, voltage or any other electromagnetic signal may be used and/or calibrated in order to indicate normal functioning versus encountering impediments, and current, voltage or any other electromagnetic signal exceeding the threshold may be interpreted as having encountered an impediment. Accordingly, the microcontroller 124 may identify, for example, if someone has caught their fingers in the door or that a child or other person or object may be standing in the door's swing path. When such a scenario is encountered, the microcontroller system 124 may stop or turn the motor 120 and/or the wheel 122 in the opposite direction in order to avoiding injury or other damage (e.g., release the finger from the door).

In some embodiments, once the wheel 122 reaches a certain position (e.g., by determining the number of turns it has turned), the microcontroller system 124 may be programmed to transmit a locking signal to a locking mechanism 108, which may trigger the locking mechanism 108 to lock the door 102. In such embodiments, the locking mechanism 108 may communicate with the microcontroller 124 over a wired or wireless connection. For example, the microcontroller 124 may be programmed such that "position 0" may occur when the door 102 may be in a closed position. When position 0 is recognized by the microcontroller 124, the microcontroller may trigger the locking mechanism 108 to lock the door 102. The locking mechanism 108 may include an actuating bolt that may selectively physically prevent the door 102 from moving, or may be an electronic lock, magnetic lock, etc., or other suitable locking mechanism. In some embodiments, the triggering of the locking mechanism 108 may be done using an electromagnetic, piezoelectric, and/or pneumatic system. Referring again to FIG. 1, in some embodiments, the locking mechanism 108 may be disposed in the doorframe 50 adjacent to the opener 104. In other embodiments, the locking mechanism 108 may be disposed in another location that may still enable it to selectively prevent the door 102 from moving between a closed position and an open position. In some embodiments, the locking mechanism 108 may be activated based on other types of sensing devices between the locking mechanism and the door 102 and/or the opener 104, such as optical sensors, proximity sensors, physically triggered sensors, etc.

In some embodiments, the motor 120 automatically disconnects from the wheel 122 to prevent the motor 120 from being damaged if the door 102 may be pushed or otherwise manually moved without activating the motor. For example, it is contemplated that someone may accidentally or purposefully push or pulls the door 102 manually without instead activating the door opener 104. In such scenarios, the motor 120 may disengage from the wheel 122 to allow for the wheel to rotate along with the door movement without damaging the motor.

In some embodiments, the automatic door opening system 100 may include one or more sensors 106 that may be used to activate the opener 104 and/or activate or deactivate the locking mechanism 108. The sensor 106 may be part of the microcontroller 124 or may communicate with the microcontroller remotely via a wired or wireless connection. In some embodiments, the sensor 106 may be disposed in a wall adjacent the door 102 at a convenient location and accessible height (e.g., accessible to people in wheelchairs). In some embodiments, the sensor 106 may be on the door 102, such as next to or in place of the handle 114, or may be incorporated into the handle itself. In some embodiments, the sensor 106 and/or microcontroller 124 may be located adjacent the hinged portion 110 of the door 102, which may help facilitate a wired connection to the motor 120, or alternatively be located in another location that may be suitable for access in order to transmit a signal to the motor 120 to rotate the wheel 102, or to activate the opener 104. In some embodiments, the sensor 106 and/or microcontroller system 124 may be driven by technologies such as Bluetooth, near field communication (NFC), Barcode, QR-code, radio frequency identification (RFID), etc., to enable access control. For example, these technologies may be generated via a mobile phone, user computing device, or via an alternative device (magnetic card, NFC tag, RFID card, etc.). In some embodiments, a user may remotely activate the opener 104 via the microcontroller 124 using a computing device (e.g., mobile phone, tablet, desktop, etc.), over a wireless network such as a Wi-Fi network, cellular network, etc. In such embodiments, the microcontroller 124 may be configured to be connected either wirelessly or otherwise to a network such as the Internet or a local area network (LAN), which may enable integration of the microcontroller into the Internet of Things (IoT).

In some embodiments, a user may position a mobile computing device or other device near the sensor 106 and the sensor may receive an input signal to open the door 102. The input signal may be communicated to the microcontroller 124, which may transmit a signal to the motor 120 to rotate the wheel 102. In embodiments that include a locking mechanism 108, the microcontroller 124 may also transmit a signal to the locking mechanism to deactivate (e.g., retract the bolt 109) and allow the door 102 to open. In some embodiments, the sensor 106 and/or microcontroller 124 may include a security mechanism or programming such that only certain authorized users may be allowed to activate the opener 104 to open the door. In some embodiments, the sensor 106 may include a keypad to receive a passcode or password, or may include a biometric sensor such as a fingerprint reader, retina scanner, facial recognition, etc. In some embodiments, the biometric or other security feature may be implemented via a user's computing device such as via a dedicated software application for sensing biometric features that may be running on the computing device. Once the application or other authorization system on the computing device may determine that a user may be authorized to open the door 102, the computing device may transmit a corresponding signal to the sensor 106 and/or the microcontroller 124. In some embodiments, the sensor 106 may communicate with the microcontroller 124 wirelessly, or may be connected directly to the microcontroller, or maybe hardwired.

In some embodiments, the microcontroller 124 may be programed to allow door opening access to a specific, predetermined subset of users. For example, at a university or other school setting, the microcontroller 124 on the door may be programmed to only allow access to students or faculty who are registered for a class in the specific classroom, and/or only allow access during certain time periods when those classes may occur. In another example, a hospital or other healthcare facility may restrict access to patient rooms or other hospital areas to particular staff members or visitors, and prevent unauthorized users from opening the door 102.

Figure 4:
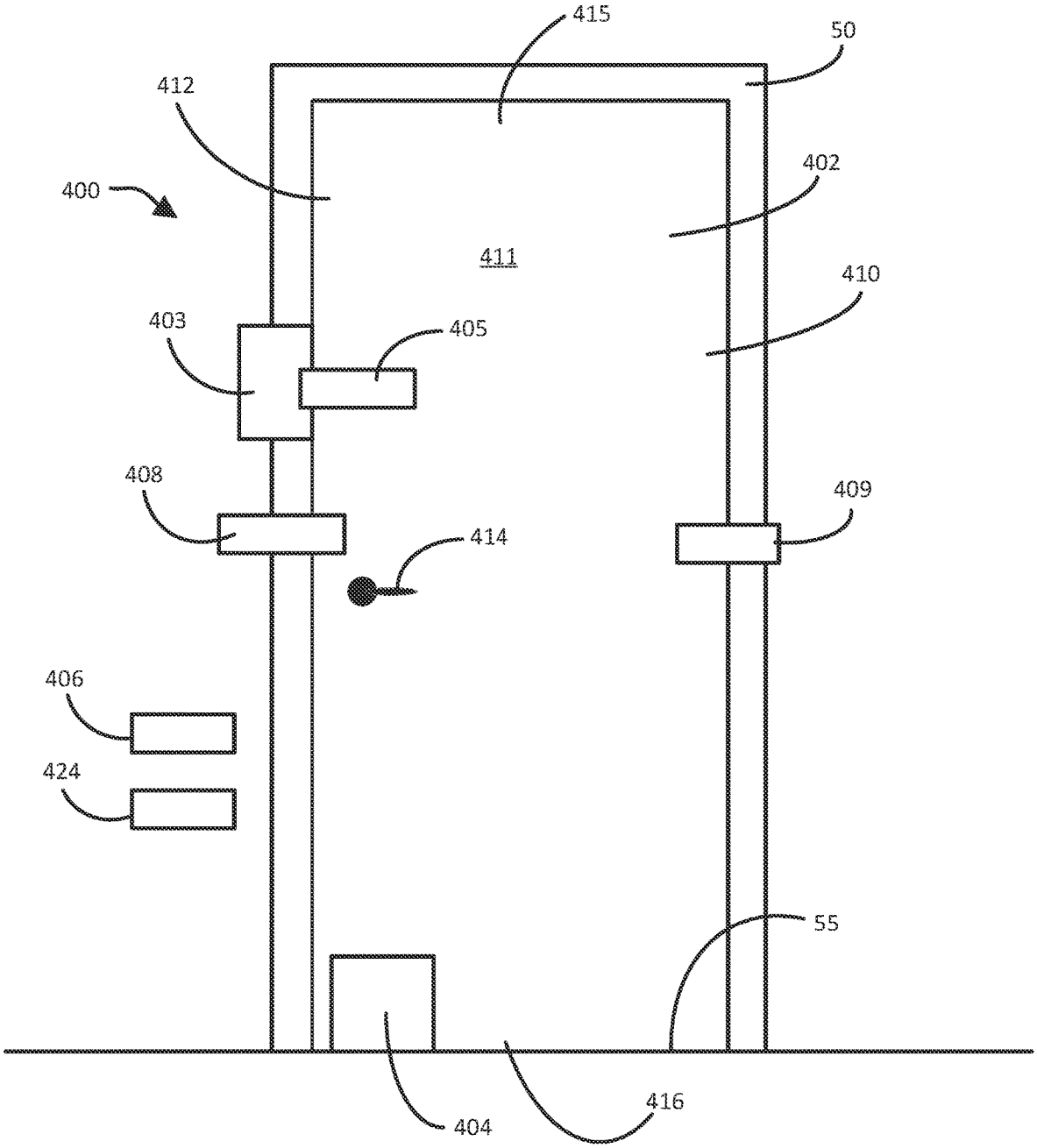
FIG. 4 is a front view of another embodiment of an automatic door opening system in accordance with the disclosure.

FIG. 4 shows another embodiment of an automatic door opening system 400 that may, in some embodiments, operate with more simplified electrical wiring. Because swinging doors may frequently be moving their positions from an open to a closed position and vice versa, wiring them may be a relatively difficult and expensive solution from a technological and commercial point of view. In some embodiments, the automatic door opening system 400 may address these issues by not including an electrical connection to the door itself, but still providing for automatic opening and closing. The system 400 may include an electromagnet that may be selectively activated to exert a Lorentz force on an opposing a magnet disposed on the door so that the door may swing open.

In some such embodiments, to open the door 402, the system 400 may include an electromagnet 420 that may be housed at least partially within a casing 419 that may be connected to the door frame 50 and may be configured to contact or be substantially near a magnet 405 that may be disposed substantially adjacent an opening portion 412 of the door. To close the door 402, the system 400 may include a closer 404 with a casing 418 substantially adjacent to the opening portion 412 and a bottom portion 416 of the door, a wheel 422 that may be powered by a spring motor and may be housed at least partially within a closer 404 and configured to contact a surface 55 adjacent the bottom portion of the door.

The system may include a microcontroller 424 that may include a memory and one or more processors. The microcontroller 424 may be in electronic communication with the electromagnet 420 and the memory may contain processor-executable instructions to receive a door activation input and, in response to receiving the door activation input, activate the electromagnet 420 to push the door 402 between the closed position and the open position.

The automatic door opener 403 may include one or more processors housed within the casing 419 and in electronic communication with the electromagnet 420, and a memory housed within the casing 419. The memory may contain processor executable instructions to receive a door activation input and, in response to receiving the door activation input, activate the electromagnet 420 which may exert a Lorentz force on a magnet 405, which may be disposed on an opening portion 412 of the door 402, that may cause the rotation of the door 402 about the hinged portion 410 between a closed position and an open position.

In another embodiment, the disclosure describes an automatic door opening system 400 including a door having a top portion 415, a bottom portion 416, a hinged portion 410, and an opening portion 412. The door 402 may be configured to selectively rotate between a closed position and an open position about the hinged portion 410. The system may include an electromagnetic opener 403 located at the door frame substantially adjacent to the opening portion 412. The automatic door opener 400 may include an electromagnet 420 housed at least partially within the casing 419 and configured to contact a magnet 405 disposed substantially near the opening portion 412 of the door 402. The system 400 may include a microcontroller 424 including a memory and one or more processors, where the microcontroller may be in electronic communication with the electromagnet 420. The system 400 may include a sensor 406 in electronic communication with the microcontroller 424. The sensor 406 may be configured to receive an input signal for opening the door 402 and communicate the input signal to the microcontroller 424. In some embodiments, the system 400 may include a locking mechanism 408 disposed adjacent to the door 402 and configured to selectively prevent the door from moving into the closed position. The locking mechanism 408 may be in electronic communication with the microcontroller 424. The memory of the microcontroller 424 may contain processor-executable instructions to receive a door activation input and, in response to receiving the door activation input, transmit an unlocking signal to the locking mechanism 408 and activate the wheel 422 that may be powered by a spring motor to move the door 402 between the open position and the closed position by exerting a frictional force of the wheel against the floor 55 adjacent the bottom portion 416 of the door.

The embodiment of the automatic door opening system 400 in FIG. 4 may include a swing-style door 402, an electromagnet 420, a magnet 405, a sensor 406, and a locking mechanism 408, such as a bolt, and a second locking mechanism 409, such as a bolt. In some embodiments, the door 402 may include two opposing faces 411, a top portion 415, a bottom portion 416, a hinged portion 410, and an opening portion 412. In some embodiments, the door 402 may be disposed within a doorframe 50 such that a hinged portion 410 of the door 402 may be pivotally connected to the doorframe and allow the door to swing between an open position and a closed position about the hinged portion over a floor 55 or other surface. The door 402 may have a handle 414 that may be turned or otherwise activated to retract or extend a latch in order to open the door. In some embodiments, the door 402 may instead include a door knob or other mechanism with which to activate or deactivate a latch and/or unlocking the door or allowing for movement. In some embodiments, the latch may be disposed either in the opening portion 412 of the door 402 or in the door frame 50, and may be actuatable between a locked or unlocked position in order to secure the door in a closed position at least until the handle 414 or other actuating mechanism is activated to actuate the latch. In some embodiments, the door 402 may include no handle at all and the latch may only be controllable via electronic, magnetic, or other wired or remote systems. In some embodiments, the latch may be retracted electronically in response to an input, as described in greater detail below.

Locating the opener 403 near or at the opening portion 412 of the door 402 may provide for a more efficient application of torque to rotate the door into an open position with respect to the hinged portion 410 of the door. Specifically, the closer that the opener 403 may be to the opening portion 412 of the door 402, the longer the moment arm may be between the opener and the hinged portion 412 of the door. A longer moment arm may result in a lower force and, accordingly, a smaller and more energy-efficient mechanism may be used in the opener 403 to rotate the door 402 about the hinged portion 412. As described in more detail below, when activated, the opener 403 may cause the door 402 to move from a closed position to an open position automatically without the need for a person to physically touch the door handle 414 or any other part of the door 402.

Figure 5:
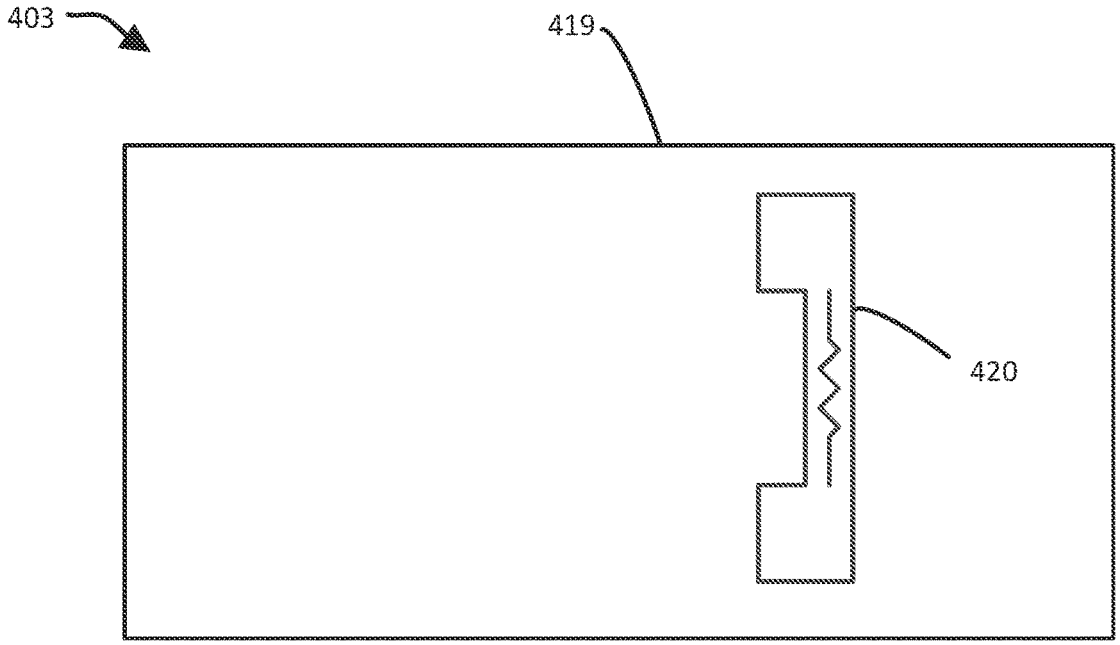
FIG. 5 is a schematic cross-sectional front view of another embodiment of an opener of the automatic door opening system of FIG. 4.

In some embodiments, such as illustrated in FIG. 5, the opener 403 may include a casing 419 that may house an electromagnet 420. In some embodiments, the electromagnet 420 may be powered through a battery, wirelessly, or through a hardwired electrical connection. In some embodiments, the electromagnet 420 may be another suitable device configured to selectively emit a magnetic field opposing that of the magnet 405, resulting in a push force to open the door 402.

Figure 6:
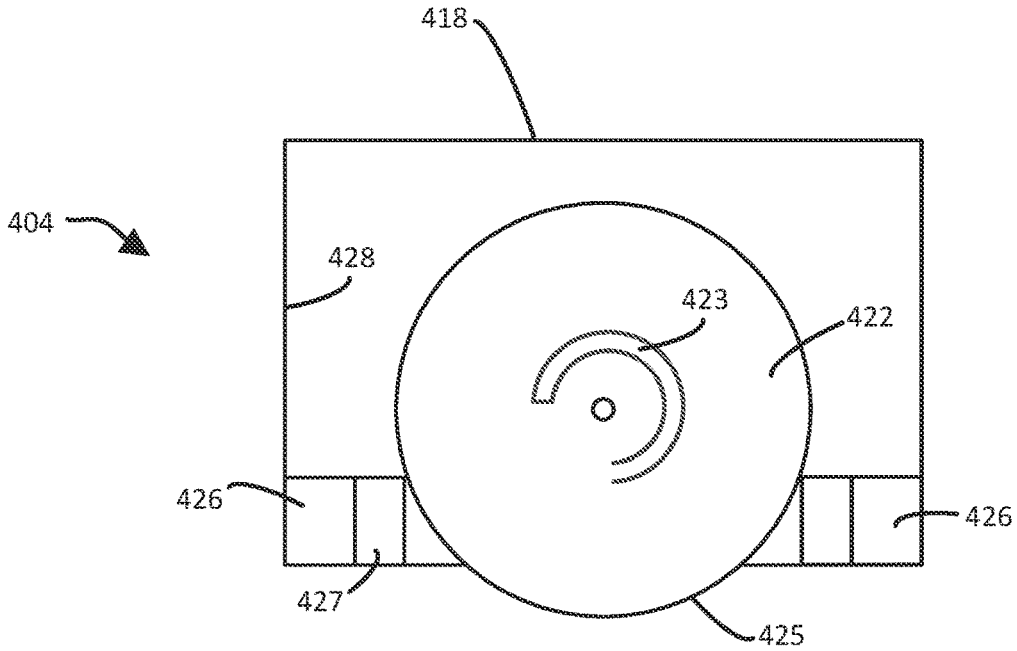
FIG. 6 is another schematic cross-sectional side view of a closer of the automatic door opening system of FIG. 4.

As shown in FIG. 6, in some embodiments, the closer 404 may include a casing 418 a spring motor 423 powered wheel 422 mounted at least partially within the casing and configured to contact the floor. The spring motor 423 may be mounted to the casing 418 and to the wheel 422 and configured to tighten and/or store potential energy as the wheel rotates a first direction as the door moves from a closed position to an open position. The spring motor 423 may then uncoil to rotate the wheel in the opposite direction, moving the door 402 from the open position to the closed position. The closer 404 may also include one or more brushes 426 that may be disposed within or on the casing so as to at least partially contact a rotating surface 425 of the spring motor powered wheel 422 and help limit or prevent build-up of dirt or other substances on the wheel surface. In some embodiments, the brushes 426 may be disposed on an inner portion 428 of the casing and disposed such that a bristle portion 427 of the brush may contact the wheel surface 425 with enough pressure to remove debris from the surface but while still allowing relatively easy rotation of the spring motor powered wheel 422. In some embodiments, the brushes 426 may be positioned on either side of the wheel 422 so that debris may be removed from the wheel surface 425 while it may be rotating in either direction (i.e., moving the door 402 into an open position or into a closed position). In some embodiments, the brushes 426 may help prevent build-up of debris that might otherwise interfere with the workings of the closer 404 such as by blocking wheel 422 rotation, jamming the spring motor, etc. In some embodiments, the spring motor wheel surface 425 may be made from or be coated in a rubber material or other high friction material that, while may provide traction between the wheel 422 and the floor 55, may also prevent debris collection. In some embodiments, the brushes 426 may be replaced with or be supplemented by another type of debris removal system, such as compressed air jets that may blow debris off of the wheel surface 425.

In some embodiments, the brushes 426 may be positioned on either side of the spring motor powered wheel 422 so that debris may be removed from the floor surface 55 while the wheel may be rotating in either direction (while the door 402 is moving into an open position or into a closed position).

In some embodiments, the microcontroller 424 may be housed within the casing 403. In some embodiments, the microcontroller 424 may be located elsewhere but in remote (wired or wireless) communication with the opener 403 and its components, such as in the sensor 406 or elsewhere. In some embodiments, the microcontroller 424 may be a single-board microcontroller and may use a variety of microprocessors and controllers. In some embodiments, the microcontroller 424 may include one or more processors and may include a memory that may contain processor-executable instructions that, when executed, may cause the opener to perform programmed actions. The microcontroller 424 may be equipped with sets of digital and analog input/output (I/O) pins that may be interfaced to various expansion boards or breadboards and other circuits. The microcontroller 424 may include serial communications interfaces, including universal serial bus (USB), which may be used for loading computer programmable instructions or other programming into the memory relating to the operation of the automatic door opener system 400. In some embodiments, the microcontroller 424 may be programmed using various programming languages such as C, C++, etc., and may also use application programming interfaces (APIs). In some embodiments, the microcontroller 424 may include use of compiler toolchains, and may provide an integrated development environment (IDE) and/or command line tools.

In some embodiments, the electromagnet 420 may be fed electrical current for only short time interval so that the induced magnetic field may exert force against the magnet 405 to open the door. In such embodiments, because the electrical current—and hence the force exerted to open the door—may not be exerted continuously but only instantly (at the instant at which the electromagnet is triggered), this embodiment (system 400) might not include a mechanism to prevent finger pinching or reversal due to encountering impediments. Further, opening a swing door 402 by pushing from the opening portion 412 of the door may be accomplished using relatively low exertion of force from the electromagnet 420 applied to the magnet 405. Therefore, the system 400 may minimize the risk of damage if someone has caught their fingers in the door or if a child or other person or object may be standing in the door's swing path.

Additionally, the system 400 may provide for adjusting the current (and hence, the force) used to push the door 402 open using the electromagnet 420 up to a certain, predetermined angle. For example, a certain relatively lower current may be delivered to the electromagnet 420 via an instruction from the microcontroller 424 to open the door 402 to smaller angle, such as about 45 degrees, and a relatively higher current may be delivered to the electromagnet to open the door a larger angle, such as about 90 degrees. In some embodiments, the microcontroller 424 may provide current to the electromagnet 420 directly. In some embodiments, the microcontroller 424 may provide instructions to a switch or other selectable mechanism to allow current to flow to the electromagnet 420 at a predetermined rate or for a predetermined amount of time that may be calculated to open the door a desired amount. In any case, the microcontroller 424 may control the selective flow of current through the electromagnet 420.

In some embodiments, once the spring motor powered wheel 404 reaches a certain position (for example, as determined by the force exerted by the electromagnet 420 to push the door open and/or by an encoder disposed adjacent the hinge portion of the door 402 or on the frame 50), the microcontroller system 424 may be programmed to transmit a locking signal to a locking mechanism 409, which may trigger the locking mechanism 409 to lock the door 402. In such embodiments, the locking mechanism 409 may communicate with the microcontroller 424 over a wired or wireless connection. For example, the microcontroller 424 may be programmed such that "position 45 degrees" may occur when the door 402 may be in an open position. The microcontroller 424 may trigger the locking mechanism 409 to lock the door 402 at, for example, a 45 degree opening position. The microcontroller 424 may also trigger the locking mechanism 409 to lock the door 402 at a particular opening position for a certain, predetermined and preprogrammed amount of time, so that the user may pass through the door without touching it. The locking mechanism 409 may include an actuating bolt that may selectively, physically prevent the door 402 from moving, or may be an electronic lock, magnetic lock, etc., or other suitable locking mechanism. In some embodiments, the triggering of the locking mechanism 509 may be done using an electromagnetic, piezoelectric, and/or pneumatic system. Once the locking mechanism 409 may be deactivated by the microcontroller 424, the spring motor powered wheel 422 may be free to close the door 402.

Referring again to FIG. 4, in some embodiments, a second locking mechanism 408 may be disposed in the doorframe 50 adjacent to the opener 103 to lock the door at the door close position, and may be triggered by the microcontroller 424. In other embodiments, the locking mechanism 408 may be disposed in another location that may still enable it to selectively prevent the door 402 from moving between a closed position and an open position. In some embodiments, the locking mechanism 408 may be activated based on other types of sensing devices between the locking mechanism and the door 402 and/or the opener 403, such as optical sensors, proximity sensors, physically triggered sensors, etc.

In some embodiments, the automatic door opening system 400 may include one or more sensors 406 that may be used to activate the electromagnetic opener 403 and/or activate or deactivate the opening and locking mechanism 408 and/or the locking mechanism 409. In some embodiments, the sensor 406 may be part of the microcontroller 424 or may communicate with the microcontroller remotely via a wired or wireless connection. In some embodiments, the sensor 406 may be disposed in a wall adjacent the door 402 at a convenient location and accessible height (e.g., accessible to people in wheelchairs). In some embodiments, the sensor 406 may be disposed on the door 402, such as next to or in place of the handle 414, or may be incorporated into the handle itself. In some embodiments, the sensor 406 and/or microcontroller 424 may be disposed adjacent the opening portion 412 of the door 402 to facilitate a wired connection to the electromagnet 420, or alternatively be disposed in another location that may be suitable for access in order to transmit a signal to the electromagnet 420 to activate the opener 403.

In some embodiments, the sensor 406 and/or microcontroller system 424 may be driven by technologies such as Bluetooth, near field communication (NFC), Barcode, QR-code, radio frequency identification (RFID), etc., to enable access control. For example, these technologies may be generated via a mobile phone, user computing device, or via an alternative device (magnetic card, NFC tag, RFID card, etc.). In some embodiments, a user may remotely activate the opener 403 via the microcontroller 424 using a computing device (e.g., mobile phone, tablet, desktop, etc.), over a wireless network such as a Wi-Fi network, cellular network, etc. In such embodiments, the microcontroller 424 may be configured to be connected either wirelessly or otherwise to a network such as the Internet or a local area network (LAN) thus enabling integration into the Internet of Things.

In some embodiments, a user may position a mobile computing device or other device near the sensor 406 and the sensor may receive an input signal to open the door 402. The input signal may be communicated to the microcontroller 424, which may transmit a signal to the electromagnet 420 included within the opener 403 and/or opener casing 419. In some embodiments, the signal may be an electrical current that may be sufficient to activate the electromagnet 420, such that the electromagnet induces a magnetic field sufficiently strong to apply force to the magnet 405, thereby pushing the door 402 open. In embodiments that may include a locking mechanism 408, the microcontroller 424 may also transmit a signal to the locking mechanism 408 to deactivate (e.g., retract the bolt 408) and allow the door 402 to open. In some embodiments, the sensor 406 and/or microcontroller 424 may include a security mechanism or programming such that only certain authorized users may be allowed to activate the opener 403 to open the door 402. In some embodiments, the sensor 406 may include a keypad to receive a passcode or password, or may include a biometric sensor such as a fingerprint reader, retina scanner, facial recognition, etc. In some embodiments, the biometric or other security feature may be implemented via a user's computing device such as via a dedicated software application for sensing biometric features that may be running on the computing device. Once the application or other authorization system on the computing device may determine that a user may be authorized to open the door 402, the computing device may transmit a corresponding signal to the sensor 406 and/or the microcontroller 424. In some embodiments, the sensor 406 may communicate with the microcontroller 424 wirelessly, or may be connected directly to the microcontroller, or maybe hardwired.

In some embodiments, the microcontroller 424 may be programed to allow door opening access to a specific, predetermined subset of users. For example, at a university or other school setting, the microcontroller 424 on the door may be programmed to only allow access to students or faculty who are registered for a class in the specific classroom, and/or only allow access during certain time periods when those classes may occur. In another example, a hospital or other healthcare facility may restrict access to patient rooms or other hospital areas to particular staff members or visitors, and prevent unauthorized users from opening the door 402.

The figures depict preferred embodiments for purposes of illustration only. One skilled in the art will readily recognize from the following discussion that alternative embodiments of the structures and methods illustrated herein may be employed without departing from the principles described herein.

Upon reading this disclosure, those of skill in the art will appreciate still additional alternative structural and functional designs for the systems and methods described herein through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the systems and methods disclosed herein without departing from the spirit and scope defined in any appended claims.

The invention claimed is:

1. An automatic door opening system comprising:

a door having a top portion, a bottom portion, a hinged portion, and an opening portion, the door configured to selectively rotate between a closed position and an open position about the hinged portion;

an opener connected to the door substantially adjacent the opening portion, the opener including:

a casing, and an electromagnet housed within the casing and configured to selectively receive electrical current;

a magnet disposed on the opening portion of the door such that the magnet is substantially adjacent the opener when the door is in the closed position;

a microcontroller including a memory and one or more processors, the microcontroller being in electric communication with the electromagnet and wherein the memory contains processor-executable instructions to: receive a door activation input, and in response to receiving the door activation input, activate the electromagnet to apply a magnetic force against the magnet and push the door between the closed position and the open position; and a closer disposed on the bottom portion of the door, the closer including a wheel and a spring motor configured to rotate the wheel and move the door from the open position to the closed position.

2. The automatic door opening system of claim 1, wherein the closer further comprises at least one brush disposed so as to make contact with at least one of a surface adjacent the bottom portion of the door or with a rotating surface of the wheel to remove debris.

3. The automatic door opening system of claim 1 further comprising a locking mechanism disposed adjacent to the door and configured to selectively prevent the door from moving into the open position, wherein the locking mechanism is in electronic communication with the microcontroller, and wherein the memory of the microcontroller further contains processor-executable instructions to transmit an unlocking signal to the locking mechanism in response to receiving the door activation input.

4. The automatic door opening system of claim 3, wherein the locking mechanism is configured to activate a lock preventing the door from moving to the open position upon receiving the locking signal from the microcontroller.

5. The automatic door opening system of claim 3, wherein the locking mechanism may include a bolt configured to selectively move between a locked position that prevents the door from moving from the closed position to the open position and an unlocked position that allows the door to move from the closed position to the open position.

6. The automatic door opening system of claim 1 further comprising a sensor in electronic communication with the microcontroller, wherein the sensor is configured to receive an input signal for opening the door.

7. The automatic door opening system of claim 6, wherein the sensor is disposed adjacent to the hinged portion of the door to facilitate a wired connection between the sensor and the microcontroller.

8. The automatic door opening system of claim 1 further comprising a locking mechanism in electronic communication with the microcontroller, the locking mechanism configured to selectively lock the door in the open position.

9. The automatic door opening system of claim 1, wherein the microcontroller is further configured to receive the door activation input from one or more user computing devices.

10. An automatic door opening system comprising:

a door having a top portion, a bottom portion, a hinged portion, and an opening portion, the door configured to selectively rotate between a closed position and an open position about the hinged portion;

an opener connected to the door substantially adjacent the opening portion, the opener including:

a casing, and an electromagnet housed within the casing and configured to selectively receive electrical current;

a magnet disposed on the opening portion of the door such that the magnet is substantially adjacent the opener when the door is in the closed position;

a microcontroller including a memory and one or more processors, the microcontroller being in electric communication with the electromagnet;

a sensor in electronic communication with the microcontroller, wherein the sensor is configured to receive an input signal for opening the door and communicate the input signal to the microcontroller;

a locking mechanism disposed adjacent to the door and configured to selectively prevent the door from moving into the open position, the locking mechanism being in electronic communication with the microcontroller; and a closer disposed on the bottom portion of the door, the closer including a wheel and a spring motor configured to rotate the wheel and move the door from the open position to the closed position;

wherein the memory contains processor-executable instructions to:

receive a door activation input, and in response to receiving the door activation input, activate the electromagnet to apply a magnetic force against the magnet and push the door between the closed position and the open position.

11. The automatic door opening system of claim 10 further comprising a second locking mechanism in electronic communication with the microcontroller, the locking mechanism configured to selectively lock the door in the open position.

* * * * *